US005553799A

United States Patent [19]

Todo

[11] Patent Number: 5,553,799

[45] Date of Patent: Sep. 10, 1996

[54] AUXILIARY YARN RELEASING APPARATUS

[75] Inventor: Yuji Todo, Nagaokakyo, Japan

[73] Assignee: Murata Kikai Kabushiki Kaisha, Kyoto, Japan

[21] Appl. No.: 197,886

[22] Filed: Feb. 17, 1994

[30] Foreign Application Priority Data

Feb. 24, 1993 [JP] Japan ..... 5-012589 U

[51] Int. Cl.[6] ..... B65H 49/00; B65H 69/04

[52] U.S. Cl. ..... 242/128; 57/354; 242/35.6 E

[58] Field of Search ..... 242/128, 35.6 R, 242/18 R, 35.5 R, 157 R, 35.6 E; 57/354, 355, 356, 357

[56] References Cited

U.S. PATENT DOCUMENTS

| | | | |
|---|---|---|---|
| 2,170,194 | 8/1939 | Griggs, Jr. | 242/128 |
| 3,568,949 | 3/1971 | Riha | 57/354 X |
| 4,673,138 | 6/1987 | Ichiba | 57/354 X |
| 4,901,931 | 2/1990 | Mista | 242/18 R |
| 4,917,326 | 4/1990 | Kojima et al. | 242/128 |
| 5,092,531 | 3/1992 | Grecksch et al. | 242/18 R |
| 5,106,032 | 4/1992 | Tanigawa | 242/128 |
| 5,377,923 | 1/1995 | Matsui et al. | 242/18 R X |

*Primary Examiner*—Michael R. Mansen
*Attorney, Agent, or Firm*—Armstrong, Westerman, Hattori, McLeland & Naughton

[57] ABSTRACT

An auxiliary yarn releasing apparatus which can control the releasing tension of a yarn of a thick yarn number count is proposed. The auxiliary yarn releasing apparatus is constructed such that a cover portion which covers over a substantially entire chase portion of a yarn supply bobbin is provided on a balloon controlling member which is put over a take-up tube as releasing of a yarn of a yarn supply bobbin proceeds.

5 Claims, 3 Drawing Sheets

AUXILIARY YARN RELEASING APPARATUS

BACKGROUND OF THE INVENTION

1. Field of the Invention

This invention relates to a yarn releasing apparatus for use with an automatic winder wherein a large number of yarns of yarn supply bobbins produced, for example, on a ring spinning frame are pieced and taken up onto a single cone- or cheese-shaped take-up package while removing defective portions of them such as slubs, and particularly to an auxiliary yarn releasing apparatus which can cope with taking up of yarns of a thick yarn number count.

2. Related Art Statement

An automatic winder includes a large number of spindles of winding units disposed in parallel to each other, and a mechanical arrangement of one of such spindles will be described with reference to FIG. 5.

Referring to FIG. 5, a winding unit 1 is fixed in position by a support pipe 2 and a duct 3, and a yarn Y, drawn out from a yarn supply bobbin 4, supplied to and positioned at a predetermined position of the unit passes a balloon braker 6, a tenser 7, of the disk or gate type, for applying a predetermined tension, a slub catcher 8 for detecting a defective portion of a yarn, and so forth, and is taken up onto a take-up package 14 which is rotated by a traverse drum 13. Reference numeral 15 denotes a yarn joining apparatus, 16 a suction mouth for guiding an upper yarn on the package side to the yarn joining apparatus 15, and 17 a relay pipe for guiding a lower yarn on the yarn supply bobbin side, to the yarn joining apparatus 15. Each winding unit includes the members mentioned above, and a large number of such winding units 1 are provided in parallel to each other to construct an automatic winder. Meanwhile, yarn supply bobbins 4 are supplied to a re-winding position A of the winding unit 1 by way of a supply conveyor 11 and a rotary disk 19 while they remain in a condition wherein they are fitted individually on independent trays 18. Then, an empty bobbin 4' from which taking up of a yarn has been completed, is discharged to a discharge conveyor 12, and a new yarn supply bobbin 4 is supplied instead. It is to be noted that a yarn end Y1 is inserted in a hollow at a top portion of a yarn supply bobbin 4 positioned at the winding position A so that the yarn Y of the yarn supply bobbin 4 may be blown up and sucked into the suction pipe 17.

By the way, the yarn Y released from a chase portion **4*a* is ballooned until it reaches a balloon guide 10. As a result of the ballooning, the yarn releasing force is increased and may cause a yarn break. Consequently, as shown in FIG. 5, a balloon of the yarn released from the yarn supply bobbin 4 is limited by means of the balloon braker 6** in the form of a tube of a quadrangular prism to keep the shape of the balloon at the yarn releasing portion to a suitable shape.

Since the balloon braker 6 is positioned above the yarn supply bobbin 4, from the lower side of the guide plate 10, and is secured to a machine frame 5, as the yarn releasing operation of the yarn supply bobbin 4 proceeds, the distance from the chase portion **4*a* of the yarn supply bobbin 4 to the lower end of the balloon braker 6 increases gradually, and there is a tendency that the operation of the balloon braker 6 becomes worse. Therefore, it is also proposed that, as shown in FIG. 6, the balloon braker 6 is formed as a cylinder and is moved down gradually following releasing of the yarn of a yarn supply bobbin. In particular, the balloon braker 6 moves down, following releasing of the yarn, from a start position at which the lower end of the balloon braker 6 covers a little over a take-up tube 4*b* to a lower limit position of a solid line so that the balloon brake 6 may be put over the take-up tube 4*b* to maintain the distance L from the lower end of the balloon braker 6 to the chase 4*a*** to an appropriate value. Accordingly, even when the last end of winding approaches, the condition wherein the balloon is limited is maintained.

If a yarn of a thick yarn number count (for example, a thicker yarn than a yarn having a meter number count Nm 20) is rewound using the auxiliary yarn releasing apparatus of FIG. 6, described in the prior art, then there is a problem in that the centrifugal force acting upon the yarn becomes so high that the yarn released from the chase portion **4*a* enters the balloon braker 6 (particularly a balloon of the yarn A released from a lower portion of the chase portion 4*a* becomes large as shown at A) and the variation of the yarn releasing tension increases as the absolute value of the yarn releasing tension increases. Further, while there is an example wherein a small umbrella is provided at an entrance of the balloon braker 6**, a balloon further expands from an outer edge of the umbrella, which reversely makes a cause of a rise of the tension.

The present invention has been accomplished during experimental investigation for causes from which such problems of the prior art arise.

SUMMARY OF THE INVENTION

It is an object of the present invention to provide an auxiliary yarn releasing apparatus of the type which employs a balloon controlling member which is put over a take-up tube upon releasing of a yarn of a yarn supply bobbin, which can control the releasing tension of a yarn of a thick yarn number count.

In order to attain the object described above, an auxiliary yarn releasing apparatus is constructed such that a covering member, which covers over a substantially entire chase portion, is provided on a balloon controlling member which is put over a take-up tube as releasing of a yarn of a yarn supply bobbin proceeds.

The covering member, provided on the balloon controlling member, covers over the substantially entire chase portion, and a balloon of a yarn released from the chase portion does not become larger than the size of the covering member. The covering member moves down as releasing of the yarn of the chase portion proceeds, and the releasing angle of the yarn being released is maintained to an appropriately large angle and the balloon does not expand to protrude from the umbrella portion.

DETAILED DESCRIPTION OF PREFERRED EMBODIMENT

Figure 1:
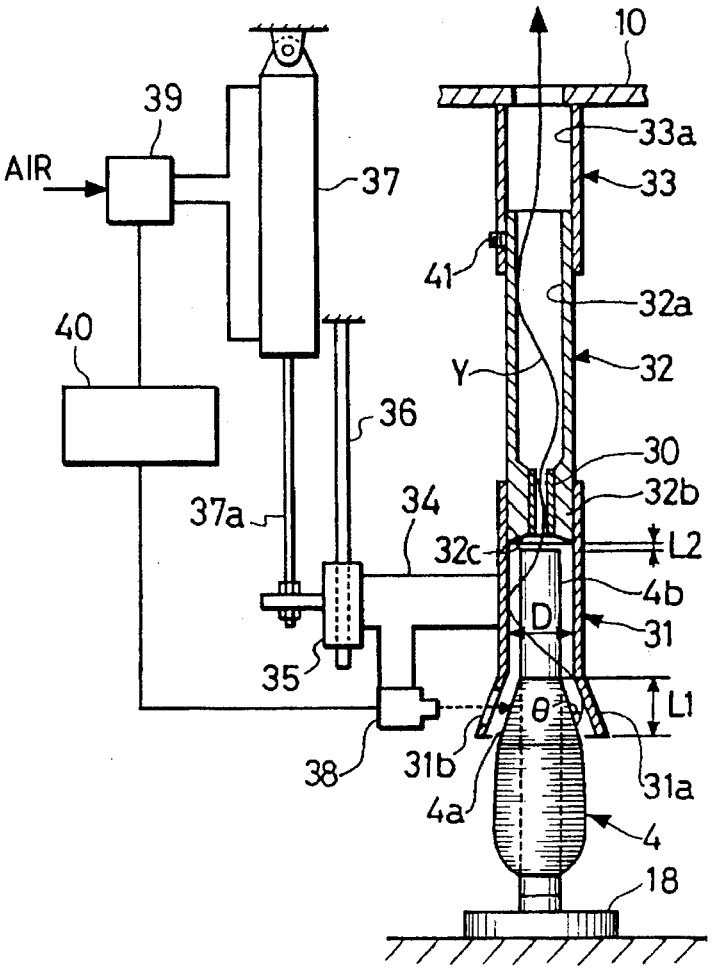
FIG. 1 is a view showing an auxiliary yarn releasing apparatus of the present invention.

In the following, an embodiment of the present invention will be described with reference to the drawings. FIG. 1 is a view showing an auxiliary yarn releasing apparatus of the present invention.

Referring to FIG. 1, the auxiliary yarn releasing apparatus includes, as principal members, a tubular member 31 serving as a balloon controlling member, a restriction section 30, a pair of tubular members 32 and 33, and a cylinder 37, a sensor 38 and a controller 40 which serve as a lifting mechanism. Particularly, a covering member 31*a* is provided on the tubular member 31, and an inspection hole 31*b* is formed in the covering member 31*a*.

A first balloon controlling member is the tubular member 31 of a large diameter, and a lower portion 31*a* terminates in an umbrella shaped covering. Portion tubular member 31 is loosely fitted on an outer periphery of the tubular member 32. Further, the tubular member 31 is mounted on a lifting block 35 by way of a bracket 34. The lifting block 35 is mounted for sliding movement on a rod 36, and the lifting block 35 is further connected to a rod 37*a* of a cylinder 37. Accordingly, the tubular member 31 can be lifted and dropped in response to expansion and contraction of the rod 37*a* of the cylinder 37. Further, as releasing of the yarn of the yarn supply bobbin 4 proceeds, the tubular member 31 successively drops so that the distance L1 from a chase portion 4*a* may be substantially constant, and is successively put over a take-up tube 4*b* of the yarn supply bobbin 4 until the covering member 31*a* covers over the substantially entire chase portion 4*a* (an area greater than 90% of the surface area) with a predetermined gap left between them. And, the covering member 31*a* plays the role of suppressing, by keeping the extent of a balloon of the yarn released from the chase portion 4*a* to an appropriate extent to assure a large yarn releasing angle θ, a rise of the yarn releasing tension and occurrence of sloughing and fluff. Even if a yarn of a thick yarn number count tends to expand by its own centrifugal force, it will not protrude from the covering member 31*a*, and an increase of the tension arising from a large balloon is prevented. Further, the inner diameter D of the tubular member 31 must necessarily be smaller than the outer diameter of a yarn layer of the yarn supply bobbin 4 but larger than the outer diameter of the take-up tube 4*b*. Further, the effect arising from successive dropping of the tubular member 31 is available with a skinny bobbin to the utmost, and since the degree of the effect does not present a significant difference whether the tubular member 31 drops or does not drop farther than that, the lower limit position of the movement of the tubular member 31 is a position in the proximity of the yarn layer of the skinny bobbin.

The restriction portion 30 includes a ceramic pipe fitted in a thick material portion 32*b* of the tubular member 32 and is positioned above the take-up tube 4*b* of the yarn supply bobbin 4 by way of the tubular member 33. Further, the lower end side of the thick material portion 32*b* of the tubular member 32 terminates in a conical portion 32*c* and facilitates passage of the yarn Y to the restriction portion 30. The restriction portion 30 controls the variation of the ballooning condition of the yarn released from the lower end or the upper end of the chase portion 4*a* to reduce the influence upon an upper side balloon to stabilize the upper side balloon. In order for the restriction portion 30 to play such a role thereof as described above, the inner diameter of the restriction portion 30 must necessarily be smaller than the outer diameter of the take-up tube 4*b*. It is to be noted that it is also possible to provide the restriction portion 30 on the tubular member 31 side so that the restriction portion 30 may move together with upward and downward movement of the tubular member 31.

The upper end of the tubular member 32 is fitted in the tubular member 33 depending from the guide plate 10 and is secured to the tubular member 33 by means of a bolt 41. And, an inner bore portion 32*a* of the tubular member 32 and an inner bore portion 33*a* of the tubular member 33 extend from the restriction portion 30 to the guide plate 10, and a balloon of the yarn above the restriction portion 30 is controlled by the inner bore portions 32*a* and 33*a*. Further, the lower end of the tubular member 32 is disposed at a substantially fixed distance L2 from the top portion of the take-up tube 4*b* so that, upon changing a bobbin, the yarn supply bobbin 4 may not interfere with the tubular member 32.

Figure 2:
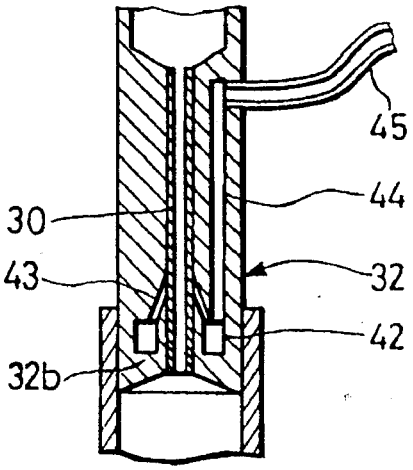
FIG. 2 is an enlarged sectional view of a restriction section.

FIG. 2 is an enlarge sectional view of the restriction portion 30. The variation of a balloon ranging to the guide plate 10 can be prevented to narrow the variation range of the yarn tension by means of the restriction portion 30. However, due to the presence of the long restriction portion 30, threading of a yarn is impossible. Thus, a ring space 42 is provided in the thick material portion 32*b* of the tubular portion 32, and one or more injection holes 43 which extend from the ring space 42 and are opened obliquely upwardly to the inner bore portion 32*a* are provided. Compressed air is supplied into the ring space 42 through a vertical hole 44 and a hose 45, and the air is jetted from the injection holes 43 so that an ascending current is formed. A yarn end is raised by the ascending current, and consequently, threading of the yarn is performed with certainty.

Subsequently, the sensor 38, the cylinder 37 and the controller 40 which serve as the lifting mechanism will be described with reference to FIG. 1. The sensor 38 is mounted on the bracket 34 and detects the chase portion 4*a* of the yarn supply bobbin 4. The controller 40 which receives the input of the sensor 38 renders a bidirectional control valve 39 so that the piston rod 37*a* of the cylinder 37 can be gradually extended to keep the distance L1 between the tubular member 31 and the chase portion 4*a* substantially fixed. A distance sensor is used for the sensor 38, and the inspection hole 31*b* is formed in the covering member 31*a* of the tubular member 31 in order to allow passage of light therethrough. As releasing of the yarn of the chase portion 4*a* proceeds, the distance from the sensor 38 to the chase portion 4*a* increases, and the sensor 38 develops an OFF signal soon. The controller 40, which receives the OFF signal, causes the piston rod 37*a* of the cylinder 37 to be extended by way of the bidirectional control valve 39. Consequently, the distance from the sensor 38 to the chase portion 4*a* is decreased, and the sensor 38 develops an ON signal soon. The controller 40, which receives the ON signal, stops the piston rod 37*a* of the cylinder 37 by way of the bidirectional control valve 39. By repetition of this cycle, the tubular member 31 successively drops as releasing of the yarn proceeds.

Figure 3:
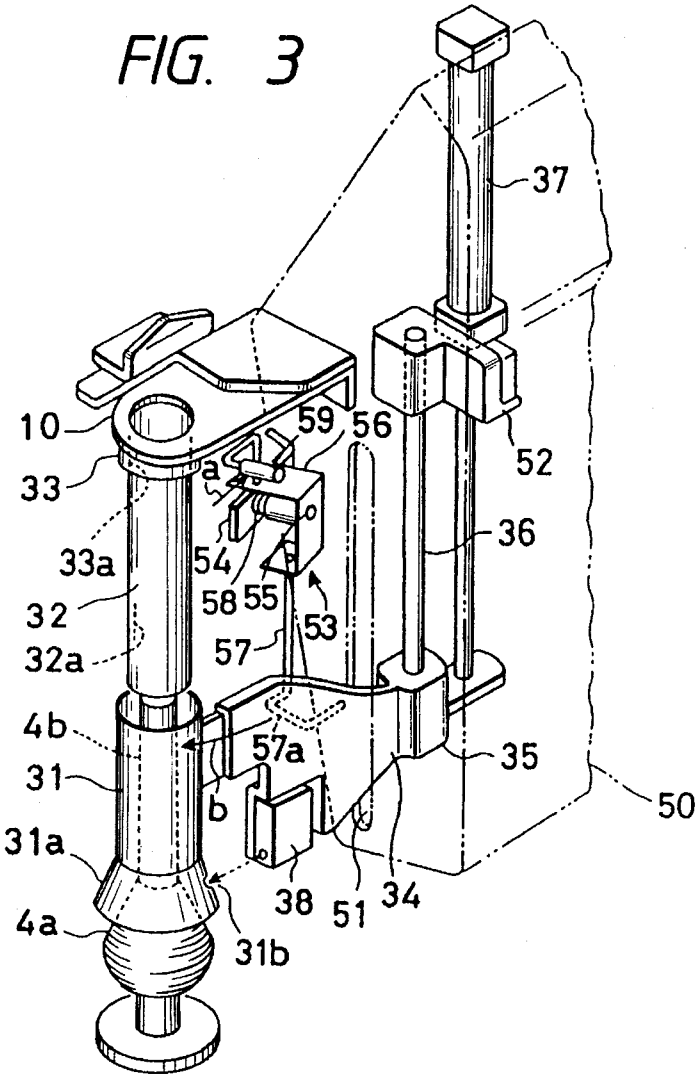
FIG. 3 is a perspective view showing an operating condition of the auxiliary yarn releasing apparatus of the present invention.
Figure 5:
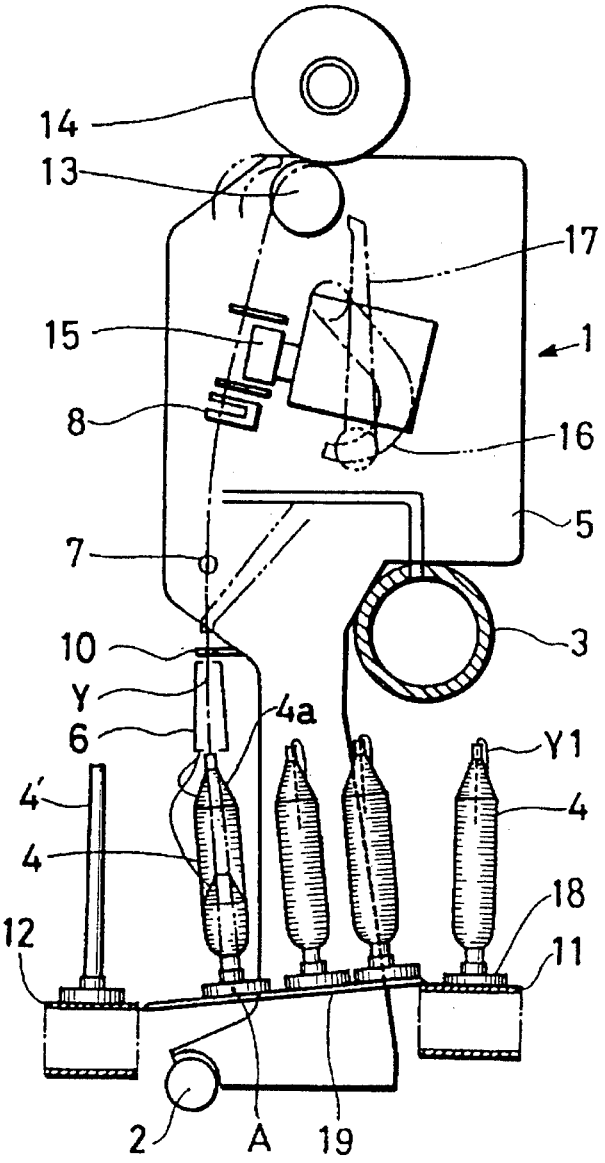
FIG. 5 PRIOR ART
FIG. 5 is a view showing an arrangement of a prior art apparatus of a winding unit.
Figure 6:
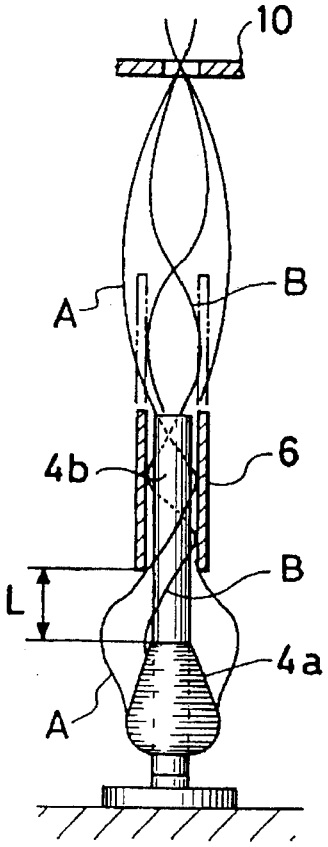
FIG. 6 PRIOR ART
FIG. 6 is a view showing a conventional auxiliary prior art yarn releasing apparatus.

Further, an ancillary apparatus to the auxiliary yarn releasing apparatus will be described with reference to FIG. 3. The lifting block 35, the rod 36 and the cylinder 37 are accommodated in a case 50, and the bracket 34 protrudes from a slit 51 of the case 50 and a rubber cover not shown having a slit formed therein is adhered to the slit 51. A fixing block 52 to which the cylinder 37 is secured and in which the rod 36 is fitted for sliding movement is secured to an inner face of the case 50 by means of bolts. Further, the guide plate 10 is secured to a side face of the case 50 by means of bolts.

Further, also a kink preventor 53 is secured to the side face of the case 50. The kink preventor 53 is constructed such that a frame member 56 is supported for rocking motion on a shaft 55 provided to project from the bracket 54 and a lever 57 having an end in the form of a bent portion 57*a* bent in a channel shape depends from the frame member 56.

Figure 4:
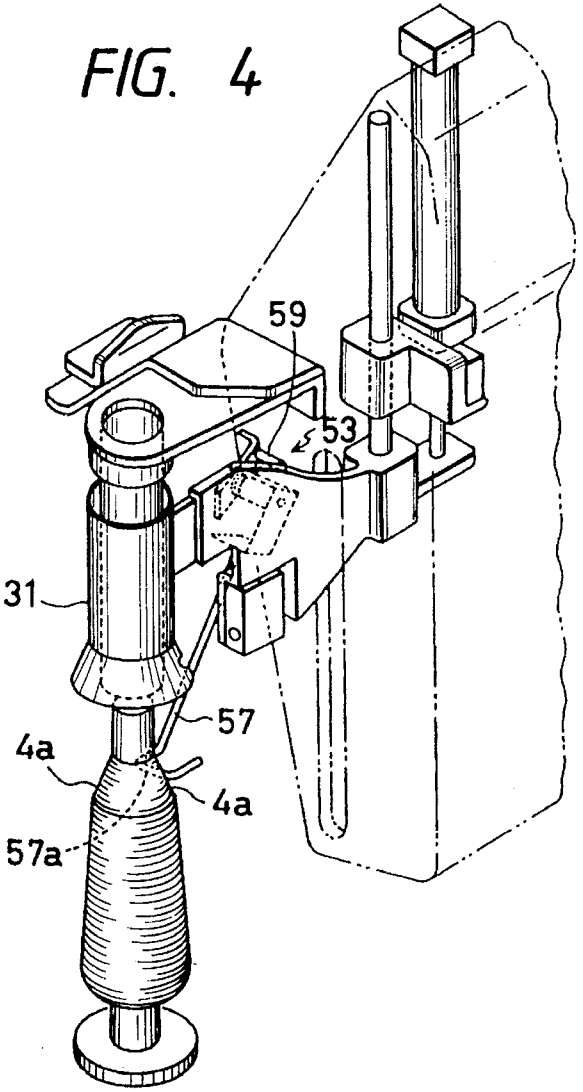
FIG. 4 is a perspective view showing the operating condition of the auxiliary yarn releasing apparatus of the present invention.

While the frame member 56 normally keeps a posture shown under the biasing force of a coil spring 58, if a roller 59 is pushed in the direction indicated by an arrow mark a, the frame member 56 and the lever 57 are rocked as indicated by an arrow mark b so that the bent portion 57*a* is abutted with the take-up tube 4*b* or the chase portion in a condition prior to releasing of a yarn. The kink preventor 53 is positioned behind the bracket 34, and since the rocking direction a is directed from the oblique rear to the take-up tube 4*b*, in a condition wherein the bracket 34 is lifted as shown in FIG. 4, the lever 57 does not interfere with the bracket 34. In a condition wherein rewinding is stopped for joining of yarns, the tubular member 31 is lifted, and when the bent portion 57*a* of the lever 57 is abutted with the chase portion 4*a* (or the take-up tube 4*a* after releasing of the yarn proceeds), the loosened yarn of the chase portion 4*a* is released in an unwinding condition, and consequently, occurrence of a kink defect is prevented.

Subsequently, operation of the auxiliary yarn releasing apparatus described above will be described with reference to FIG. 3. As releasing of a yarn proceeds, the tubular member 31 serving as the balloon controlling member drops and the condition wherein the substantially entire chase portion 4*a* is covered with the covering member 31*a* is maintained. Consequently, a balloon of a yarn of a thick yarn number count released from the chase portion 4*a* does not expand and a rise of the tension is suppressed. In particular, since a balloon itself makes a cause of a rise of the tension, if the releasing angle is appropriate, then the balloon need not be large any more, and consequently, the balloon is limited to its lower limit by means of the umbrella portion. Further, also the yarn released from the lower end of the chase portion 4*a* and the yarn released from the upper end of the chase portion 4*a* are limited in motion thereof when they pass the restriction portion 30. Further, the inner bore portion 32*a* of the tubular member 32 and the inner bore portion 33*a* of the tubular portion 33 extend to the guide plate 10, and an upper side balloon of the yarn Y is controlled by the inner bore portions 32*a* and 33*a*. As a result, even if the releasing condition is different as at the lower end and the upper end of the chase portion 4*a*, the variation of the balloon after the yarn passes the restriction portion 30 is reduced. In this manner, an expansion of a balloon from the chase portion 4*a* is controlled and the increase and the variation of the tension are reduced by a synergetic effect of the tubular member 31, the restriction portion 30 and the tubular members 32 and 33 which drop as releasing of the yarn proceeds, and occurrence of sloughing can be suppressed.

If a defective portion such as a slub is detected, then the defective portion is removed and joining of yarns is performed. In this instance, as shown in FIG. 4, the tubular member 31 is lifted to its upper limit position at which the bent portion 57*a* of the rod 57 of the kink preventor 53 is abutted with the chase portion 4*a* or the take-up tube, and occurrence of a kink (twist) is prevented by the weight of the yarn as releasing of the yarn proceeds. Pushing in of the roller 59 to move the kink preventor 53 to the rocked position shown in FIG. 4 is performed by a lever which is operated by another lever provided for opening a tensor not shown. Since the tensor is opened without fail upon yarn joining of yarns, it can be operated in an interlocking relationship with operation of the kink preventor 53.

An auxiliary yarn releasing apparatus of the present invention is constructed such that a covering member which covers over a substantially entire chase portion is provided on a balloon controlling member which is put over a take-up tube as releasing of a yarn of a yarn supply bobbin proceeds, and since a balloon of a yarn released from the chase portion is prevented from becoming larger than the covering member and the balloon controlling member is moved down as releasing of the yarn of the chase portion proceeds, the balloon does not become large at the chase portion and a rise of the yarn releasing tension can be suppressed even for a yarn of a thick yarn number count.

What is claimed is:

1. An auxiliary yarn releasing apparatus having a balloon controlling member with a covering member for covering a chase portion of a yarn supply bobbin, said balloon controlling member being positioned over a take-up tube of said bobbin for movement relative to said take-up tube as release of yarn from said yarn supply bobbin progresses and is being loosely fitted on an outer periphery of a tubular member having a restricted portion with a passage smaller in diameter than an outer diameter of said take up tube, said tubular member having said restricted portion being fixed above an upper end of said bobbin and said restricted portion in said tubular member is positioned at a predetermined position above an upper end of said bobbin, said passage having at least one injection hole, for supplying compressed air, opening obliquely upward in an inner bore of said passage.

2. An auxiliary yarn releasing apparatus having a balloon control for releasing yarn from a chase portion of a yarn supply bobbin and for controlling ballooning of such released yarn, comprising:

a tubular body having axially aligned tubular upper and lower portions;

said tubular upper portion having a lower open end slidable in the upper open end of said tubular lower portion;

said tubular lower portion having an open upper end slidably adjustable on the outer surface of the lower end of said upper portion and a lower umbrella shaped open end portion for forming a housing around a chase portion of a yarn supply bobbin axially aligned with the axis of said tubular body;

means for adjusting said lower tubular portion relative to said upper tubular portion;

a restriction portion between said lower end of said tubular upper portion and said upper end of said tubular lower portion, said restriction portion having a bore extending axially from said tubular lower portion into said tubular upper portion; and at least one injection hole extending obliquely upwardly into said bore for supplying compressed air into said bore for feeding yarn removed from said chase portion of yarn supply bobbin upwardly through said bore and through said intermediate and upper tubular portions and through said guide hole in said guide plate.

3. An auxiliary yarn releasing apparatus, as recited in claim 2, in which said restriction portion, said bore and said oblique injection hole are in the lower end of said tubular upper portion.

4. An auxiliary yarn releasing apparatus, as recited in claim 3, in which said bore is a ceramic pipe.

5. An auxiliary yarn releasing apparatus, as recited in claim 2, in which said means for adjusting said lower tubular portion relative to said upper tubular portion comprises an inspection hole in said umbrella end portion of said lower tubular portion for viewing said chase portion of said yarn supply bobbin, a sensor mounted on said tubular lower portion for viewing said chase portion of said yarn supply bobbin through said inspection hole and moving means connected to said tubular lower portion and activated by said sensor means for moving said tubular lower portion axially relative to said bobbin for aligning and maintaining the alignment of said inspection hole and said lower umbrella shaped open end portion of said lower tubular portion with said chase portion.

* * * * *